United States Patent [19]

Blymiller

[11] Patent Number: 4,909,385

[45] Date of Patent: Mar. 20, 1990

[54] MULTI-PURPOSE MOTOR HANDLING AND PACKING CONTAINER

[75] Inventor: Bruce S. Blymiller, El Paso, Tex.

[73] Assignee: A. O. Smith Corporation, Milwaukee, Wis.

[21] Appl. No.: 718,901

[22] Filed: Apr. 1, 1985

[51] Int. Cl.[4] ..... B65D 85/68

[52] U.S. Cl. ..... 206/319; 206/480; 206/597

[58] Field of Search ..... 206/319, 480, 481, 461, 206/466, 597, 326

[56] References Cited

U.S. PATENT DOCUMENTS

| | | | |
|---|---|---|---|
| 1,705,050 | 3/1929 | Taylor | 206/461 |
| 2,387,639 | 10/1945 | Bouchelle | 206/481 |
| 3,246,744 | 4/1966 | Marnon | 206/597 |
| 3,315,800 | 4/1967 | Wagner | 206/597 |
| 3,797,653 | 3/1974 | Goodsite | 206/326 |
| 4,307,805 | 12/1981 | Welch et al. | 206/326 |

FOREIGN PATENT DOCUMENTS

| | | | |
|---|---|---|---|
| 67831 | 10/1957 | France | 206/461 |

*Primary Examiner*—Joseph Man-Fu Moy

*Attorney, Agent, or Firm*—Andrus, Sceales, Starke & Sawall

[57] ABSTRACT

A packing and handling container for articles such as electric motors includes a box-like structure having a generally rectangular base and four walls which extend vertically from the base. Two opposing walls include a generally U-shaped opening positioned such that the bottom of the opening is located a predetermined distance from the base and the predetermined distance is less than the height of the article to be packed in the container. A flexible wrapping material passes over the packed article, through the U-shaped openings and under the base, thereby securing the article against movement during shipping. The U-shaped openings are formed by cutting flaps in the sidewalls which are integrally attached to the sidewalls at the bottom of the U-shaped openings and folded into the container to provide additional support for the sidewalls and base.

11 Claims, 3 Drawing Sheets

MULTI-PURPOSE MOTOR HANDLING AND PACKING CONTAINER

BACKGROUND OF THE INVENTION

This invention relates to packaging and handling containers and more particularly to such containers which are made from a material such as paperboard and are used to transport electrical equipment or similar articles.

There is known a great variety of packaging means employing paperboard as the principal material. For certain types of commodities, the packaging means must simply contain and retain the commodity and means such as slotted cardboard boxes are satisfactory. However, for other types of commodities, such as electrical equipment, for example, paperboard is sufficiently strong to contain the article but additional packaging devices are required to restrain the movement of the commodity during shipping and handling.

It is known to ship certain articles, such as electric motors, in a cellular structure of the type generally known as an egg crate structure, which is mounted on a pallet. Motors are placed in individual cells and a variety of inserts, tubes, collars, and other supporting devices are inserted into the cells to restrain movement of the motors during shipment This results in the need for a large number of individual packing configurations for a particular product line. In order to reduce material costs, set-up costs and inventory costs, it is therefore desirable to reduce the number of packing configurations required to accommodate the product line.

SUMMARY OF THE INVENTION

This invention provides a standardized package and handling container which can be used to transport a variety of articles such as, for example, electric motors. A packing and handling container constructed in accordance with this invention comprises a box having a generally rectangular base and four walls which extend vertically from each side of the base. Two opposing walls include a generally U-shaped opening having a bottom which is spaced a predetermined distance from the base of the container such that this predetermined distance is less than the height of the article to be packed in the container. A flexible material is wrapped over the article to be packed, through the U-shaped openings and under the base, thereby securing the article against movement during shipping. In a preferred embodiment, the U-shaped openings are formed by cutting flaps which are subsequently folded into the container to reinforce the sidewall and base. The flexible wrapping material preferably exhibits elastic properties to maintain movement preventing forces on the packed article.

This invention also encompasses a method of packing an article in the above packing and handling container which comprises the steps of placing the article in the container and wrapping the flexible wrapping material over the article, through one of the U-shaped openings, under the base and through the other U-shaped opening, thereby preventing movement of the article within the container.

DESCRIPTION OF THE PREFERRED EMBODIMENT

Figure 1:
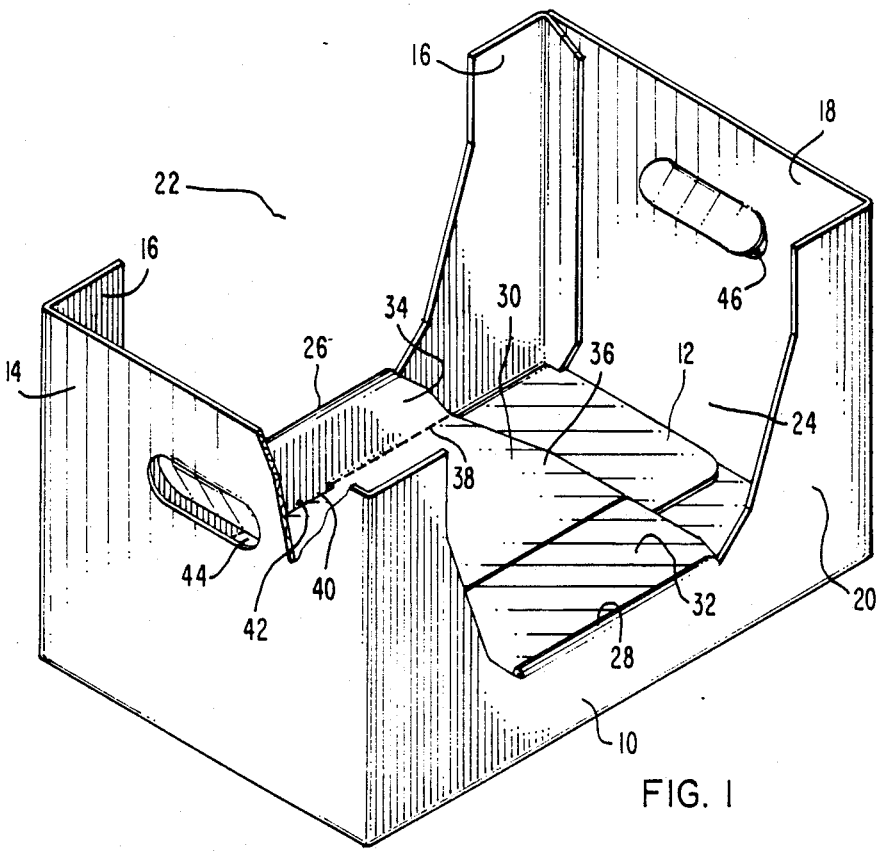
FIG. 1 is a perspective view of a packing and handling container constructed in accordance with one embodiment of the present invention.

Referring to the drawings, FIG. 1 is a perspective view of a packing and handling container 10 constructed in accordance with one embodiment of the present invention. This container is fashioned from a sheet of substantially rigid material such as paperboard or cardboard and includes a generally rectangular base 12 and four walls 14, 16, 18 and 20 extending vertically from the edges of the base. Two opposing walls 16 and 20 each define a generally U-shaped opening 22 and 24 respectively. These U-shaped openings have a width which is less than the width of the defining walls and have bottoms 26 and 28 which are spaced a predetermined distance from the base 12 of the container. This predetermined distance is less than the height of the article to be packed. The U-shaped openings 22 and 24 are formed by cutting flaps 30 and 32 from the respective walls of the container. These flaps are integrally attached to the sidewalls at the bottoms 26 and 28 of the U-shaped openings. Each flap contains two portions, for example 34 and 36 of flap 30 which are separated by a fold line 38. A tab 40 is cut from each flap along the fold line and extends into an opening 42 in the base 12 of the container. The ends of flaps 30 and 32 lie adjacent to each other near the mid-line of the base 12 and serve to reinforce the base. Handles 44 and 46 are formed in end walls 14 and 18 to permit the container to be used as an article handling device.

Figure 2:
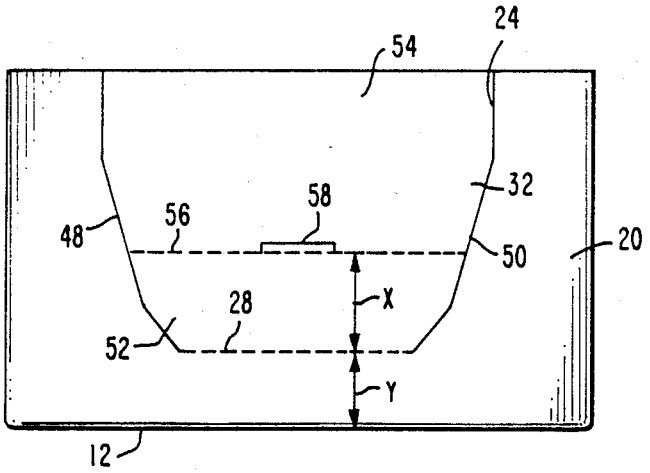
FIG. 2 is a side view of the container of FIG. 1.

FIG. 2 is a side view of the packing and handling container of FIG. 1. In this view of sidewall 20, the U-shaped opening 24 is shown to be formed by cutting along the sides 48 and 50 of the U-shaped opening to form flap 32. The bottom 28 of the U-shaped opening is integrally attached to the flap. This flap includes first and second portions 52 and 54 separated by a fold line 56. A tab 58 is also cut into flap 32 along the fold line for eventual insertion into an opening, not shown, in the base 12. The bottom 28 of the U-shaped opening is spaced a predetermined distance Y from the base. This distance is less than the height of an article to be packed within the container. The fold line 56 of flap 32 is positioned at a distance X from the bottom 28 of the U-shaped opening. The distances X and Y are approximately equal so that when the flap is folded into the container, flap portion 52 lies adjacent to the section of side 20 which lies below the bottom of the U-shaped opening and tab 58 can be inserted into an opening in the base.

Figure 3:
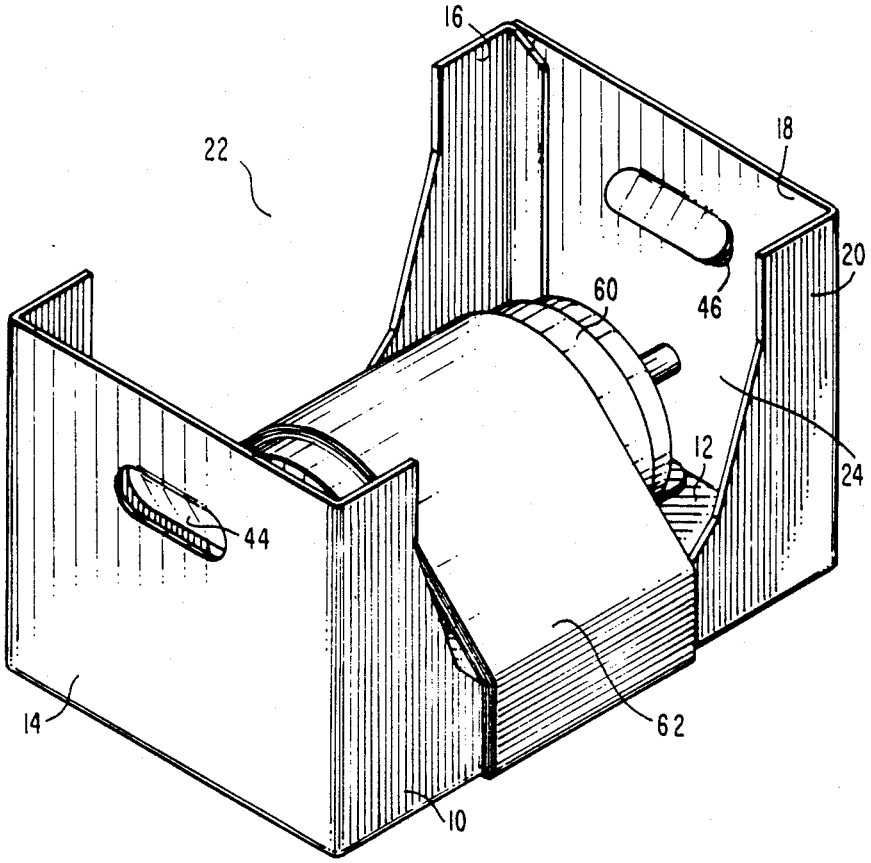
FIG. 3 is a perspective view of the container of FIG. 1 including a packed electric motor which is restrained by a flexible wrapping material.

FIG. 3 is a perspective view of the container of FIG. 1 into which an electric motor 60, having a generally cylindrical frame, has been packed. The motor is placed on the base of container 10 and a flexible stretch wrap material 62, for example Mobil Oil Co. Type Mobil-X, 90 gauge, 10 inch width at 29% stretch, passes over the motor 60, through U-shaped opening 24, under base 12 and through U-shaped opening 22. The flexible wrapping material 62 may be wrapped several times around the container and the packed article and may remain in place by static frictional forces. The flexible material preferably exhibits elastic properties to maintain forces on the packed article securing it to the base and preventing movement of the article during shipping and handling.

Figure 4:
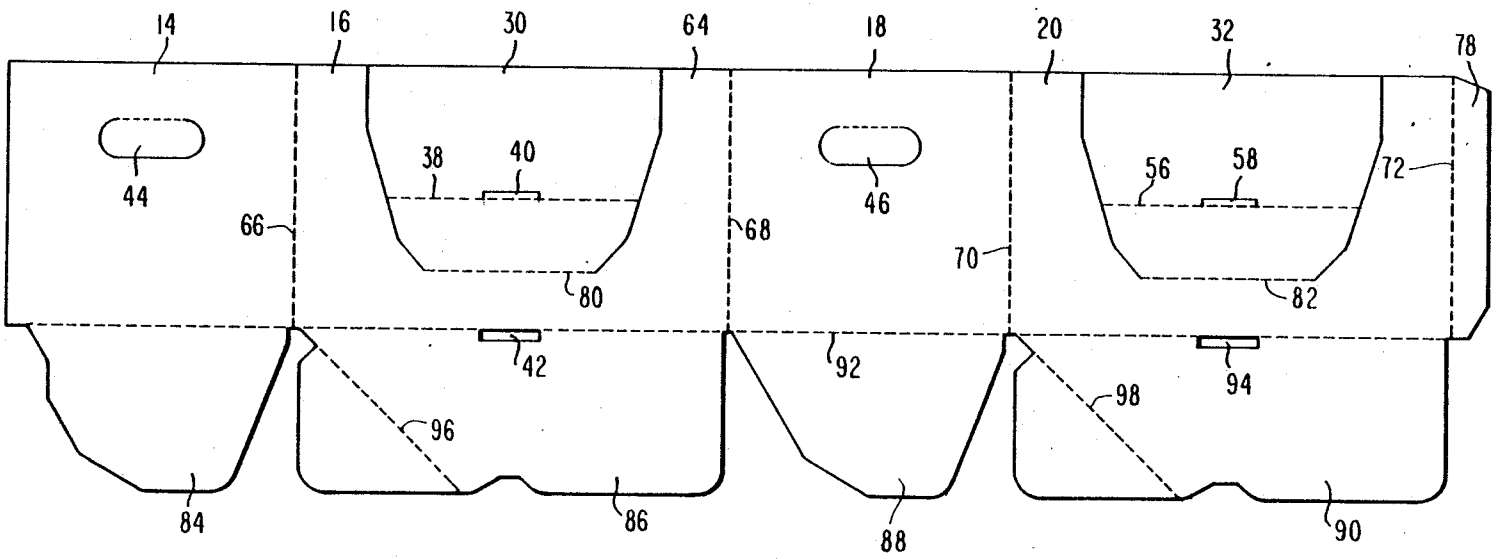
FIG. 4 is a plan view of a blank used to form the container of FIG. 1.

FIG. 4 is a plan view of a blank used to form the packaging and handling container of FIG. 1. This blank includes a generally rectangular sheet 64 of substantially rigid material such as paperboard or cardboard having a plurality of vertical fold lines 66, 68 and 70 which define pairs of opposed side and end walls 14, 16, 18 and 20. An additional vertical fold line 72 is used to define a glue tab 78. U-shaped flaps 30 and 32 are cut in opposing sidewalls 16 and 20 and are attached to the sidewalls along fold lines 80 and 82. A plurality of bottom flaps 84, 86, 88 and 90, constructed in accordance with known technology, are connected to the wall panels along a horizontal fold line 92. Bottom flaps 86 and 88 also define openings 42 and 94 which are constructed to receive tabs 40 and 58 respectively in flaps 30 and 32. Fold lines 96 and 98 are provided in bottom tabs 86 and 90 to provide a collapsible base structure in accordance with known technology. The distance between fold lines 92 and 80 is approximately equal to the distance between fold lines 80 and 38. Similarly, the distance between fold lines 92 and 82 is approximately equal to the distance between fold lines 82 and 56. By folding the U-shaped flaps into the container, a portion of each flap lies adjacent to a section of the associated sidewall positioned between the base and the bottom of the U-shaped opening.

The U-shaped openings in the opposing sidewalls of the container have a width which is less than the width of the sidewalls and the openings are approximately centered in the sidewalls. This provides full height sections at each end of the sidewalls. When a plurality of these cartons are positioned side by side in an array on a pallet, these full height sections of sidewalls provide lateral support for the end walls of the containers to prevent buckling of the sidewalls when additional layers of containers are stacked on top of the original container array.

Using the containers of the present invention, a small number of container sizes such as for example approximately five or six, can be used to adequately pack a line of electric motors which previously required hundreds of packing configurations. Therefore, inventory of cardboard is reduced along with set-up costs incurred with short orders. Material costs are reduced as a result of a reduction in required cardboard material. The design of these containers permits their use as handling totes for conveying the packed article along assembly lines. Wrapping with a stretch material provides a neater, more secure pack resulting in greater protection during shipment.

Several sizes of packing and handling containers have been constructed in accordance with this invention. For example, one container which can accommodate 22.6% of a particular small electric motor product line, had internal dimensions of 13.25×6.625×7.125 inches. It was designed for motors with no externally mounted hardware or for motors falling within the container size restraints. The container was constructed of 275 pound C-flute die cut cardboard in a snap lock style. The cardboard strength was selected for a maximum motor weight of 52 pounds.

The containers of this invention may be used as components of a pallet pack or as part of a carton used to ship individual motors. When used in a pallet pack configuration, the containers are positioned side by side on a pallet. Additional layers of motors can be added by inserting a sheet of cardboard or similar device between the layers. For individual motor shipments, a carton is formed by placing the containers of this invention within a slightly larger box having a fold down top. The resulting carton is then similar in external appearance to commonly used prior art shipping cartons.

Although the present invention has been described in terms of what is at present believed to be the preferred embodiment, it will be apparent to those skilled in the art that various changes may be made without departing from the scope of the invention. It is therefore intended that the appended claims cover such changes.

What is claimed is:

1. A packing and handling container comprising:

a box having a generally rectangular base and four walls wherein one of said walls extends vertically from each side of said base;

two opposing ones of said walls each having a generally U-shaped opening wherein each of said U-shaped openings includes a bottom spaced a predetermined distance from said base such that said predetermined distance is less than the height of an article to be packed within the container;

a flexible wrapper passing over the article to be packed, passing through said U-shaped openings adjacent to said bottoms and passing under said base, said wrapper exerting forces on said article, thereby securing said article to said base; and said wrapper comprising a plurality of layers of an elastic material and being held in place by static forces.

2. A packing and handling container as recited in claim 1, further comprising:

a pair of flaps wherein one of said flaps is integrally attached to each wall having a U-shaped opening adjacent to the bottom of the U-shaped opening;

each of said flaps including two portions separated by a fold line, a first one of said portions being positioned adjacent to one of said walls and a second one of said portions being positioned adjacent to said base.

3. A packing and handling container as recited in claim 2, wherein said base includes an aperture adjacent to each wall having a U-shaped opening and wherein each flap has a protuberance adjacent to said fold line and extending into one of said apertures.

4. A packing and handling container as recited in claim 2, wherein the width of said first portion of each of said flaps is approximately equal to said predetermined distance.

5. A packing and handling container as recited in claim 2, wherein one edge of said second portion of one of said flaps lies adjacent to one edge of said second portion of a second one of said flaps.

6. A packing and handling container as recited in claim 2, wherein said base comprises:

a plurality of partially overlapping panels; and wherein said second portion of each of said flaps overlaps sections of said panels.

7. A packing and handling container as recited in claim 1, wherein the width of each U-shaped opening is less than the length of each of the walls which define the U-shaped opening.

8. A packing and handling container as recited as claim 7, wherein each of said U-shaped openings is centered in one of said walls.

9. A blank for forming a container for an article comprising:

a sheet of generally rectangular, substantially rigid material having a plurality of vertical fold lines which define pairs of opposed side and end wall panels;

a plurality of bottom flaps connected to the lower edges of each of said panels along a first horizontal fold line;

a pair of generally U-shaped flaps, each of said U-shaped flaps being cut from one of said side panels and being attached to one of said side panels along a second horizontal fold line, wherein said first horizontal fold line and said second horizontal fold line are spaced apart by a predetermined distance; and wherein each of said U-shaped flaps includes a third horizontal fold line spaced from said second horizontal fold line by a distance which is approximately equal to said predetermined distance.

10. A method of packing an electric motor comprising the steps of:

placing a generally cylindrical electric motor in a box-like container having a generally rectangular base and four walls extending vertically from the edges of said base, wherein two opposing ones of said walls include a generally U-shaped opening positioned such that the distance from said base to the bottom of said U-shaped opening is less than the diameter of said motor; and wrapping a plurality of layers of flexible, elastic wrapping material over said motor, through one of the U-shaped openings, under said base, and through the other one of the U-shaped openings, said wrapping material exerting forces on said motor and being held in place by static forces, thereby securing said motor to said base.

11. A motor and packing container combination comprising:

a motor having a substantially cylindrical frame;

a box having a generally rectangular base and four walls wherein one of said walls extends vertically from each side of said base;

two opposing ones of said walls each having a generally U-shaped opening wherein each of said U-shaped openings includes a bottom spaced a predetermined distance from said base such that said predetermined distance is less than the diameter of said motor;

a flexible wrapper passing over the motor, passing through said U-shaped openings adjacent to said bottoms and passing under said base, said wrapper exerting forces on the motor, thereby securing the motor against substantial movement with respect to the base; and said wrapper comprising a plurality of layers of an elastic material and being held in place by static forces.

* * * * *